US006752053B2

(12) United States Patent
Rubicam

(10) Patent No.: US 6,752,053 B2
(45) Date of Patent: Jun. 22, 2004

(54) METHOD OF CUTTING A TIE WRAP

(75) Inventor: Joel N. Rubicam, Hillsboro, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/738,079

(22) Filed: Dec. 15, 2000

(65) Prior Publication Data

US 2002/0073814 A1 Jun. 20, 2002

(51) Int. Cl.[7] ..... B26D 1/00; B26D 17/00; A45D 29/00

(52) U.S. Cl. ..... 83/13; 30/28; 132/73.5; 132/75.5

(58) Field of Search ..... 30/28, 26; 132/75.5, 132/73.5

(56) References Cited

U.S. PATENT DOCUMENTS 450,703 A * 4/1891 Price ..... 30/186
1,647,241 A * 11/1927 Meier ..... 24/23 W
1,677,684 A * 7/1928 Parsons ..... 30/229
1,812,484 A * 6/1931 Howe ..... 30/131
2,400,220 A * 5/1946 Bell ..... 30/229
2,453,198 A * 11/1948 Corbett ..... 30/312
3,189,996 A * 6/1965 Casey, Jr. ..... 30/28
3,748,697 A * 7/1973 Marchese et al. ..... 24/19
4,017,923 A * 4/1977 Schantz ..... 132/73
4,106,195 A * 8/1978 Berg ..... 30/178
4,449,297 A * 5/1984 Fuchs et al. ..... 30/29
4,876,795 A * 10/1989 Chun-cheng ..... 30/254
4,982,747 A * 1/1991 Shah ..... 132/75.4
5,309,802 A * 5/1994 Mammosser ..... 30/278
5,372,166 A * 12/1994 Lai ..... 140/123.6
5,632,312 A * 5/1997 Hoffman ..... 140/123.6
5,682,722 A * 11/1997 Weder et al. ..... 53/397
5,832,612 A * 11/1998 Cornell et al. ..... 30/233
6,237,224 B1 * 5/2001 Park ..... 30/29.5
6,560,874 B1 * 5/2003 DeMezzo ..... 30/28

* cited by examiner

*Primary Examiner*—Allan N. Shoap
*Assistant Examiner*—Isaac Hamilton
(74) *Attorney, Agent, or Firm*—Kevin A. Reif

(57) ABSTRACT

A method and apparatus for cutting an end of a tie wrap after a locking mechanism of the tie wrap has been engaged includes inserting the end of the tie wrap in proximity with a curved blade of a cutting tool. Pressure is applied to the cutting tool to force the curved blade against the tie wrap until the tie wrap is cut through.

16 Claims, 7 Drawing Sheets

METHOD OF CUTTING A TIE WRAP

BACKGROUND OF THE INVENTION

1. Field of the Invention

The described invention relates to the field of cutting tools. In particular, the invention relates to a cutting tool having a curved blade for cutting a tie wrap.

2. Description of Related Art

It is common, particularly in routing network cables, to use tie wraps (also called zip ties) to bind bundles of cables together. This allows similar groupings of cables to be kept together. Tie wraps prevent cables from tangling and allowing for better cable management.

FIG. 1 shows a typical tie wrap 1. The tie wrap is typically made of plastic or nylon. One end of the tie wrap has a tie head 3; the other end of the tie wrap is a free end 7 which is typically tapered at the very end. The tie wrap is wrapped around cables or other materials meant to be bound up. The free end 7 is then put through an eye 5 of the tie head 3, and pulled tight. The tie wrap has a locking mechanism within the tie head 3 that allows the free end 7 to be pulled through the eye 5. This engages the locking mechanism and the free end 7 cannot be pulled back out of the eye 5. Thus, the tie wrap can be made tighter, but not be loosened. A number of notches or ridges 11 in the tie wrap are used by the locking mechanism to achieve the one-way tightening process. A tie wrap that has its locking mechanism engaged is referred to as a "locked tie wrap" herein.

FIG. 2 shows a tie wrap that has been tightened. There is an excess 15 of the tie wrap that extends through the eye 5. This excess tie wrap is trimmed. If the excess tie wrap 17 is trimmed flush to the tie head 3, as shown in FIG. 3, the tie head 3 buffers the sharp edges of the cut tie wrap end from causing injury to people working with or near the tie wraps. However, if the excess tie wrap 19 is cut close to but not flush with the tie head 3, as shown in FIG. 4, this produces a firm protrusion that can easily cause injury due to sharp edges.

DETAILED DESCRIPTION

One method for cutting the end of a tie wrap without leaving a sharp edge that may cause injury is to round the edges off of the trimmed end of the tie wrap. A rounded edge is less prone to cause injury than cutting with a straight cut. Another method is to cut the tie wrap so that its edge forms an angle wider than 90 degrees, as will be shown with respect to FIG. 6.

Figure 1:
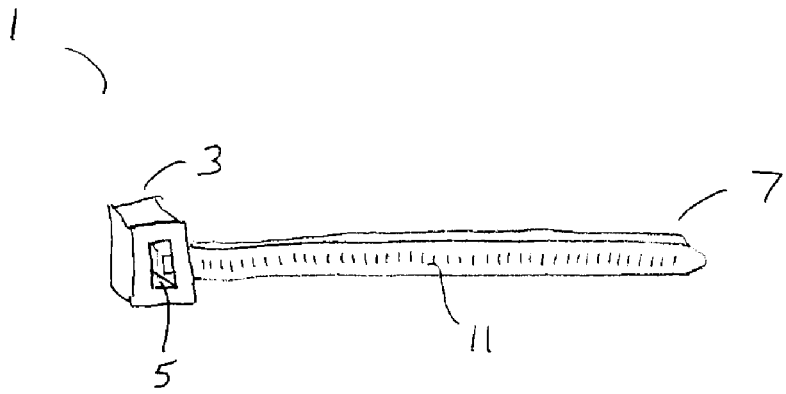
FIG. 1 shows a typical tie wrap.
Figure 2:
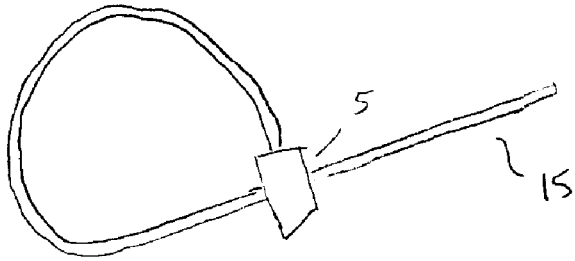
FIG. 2 shows a tie wrap that has been tightened.
Figure 5A:
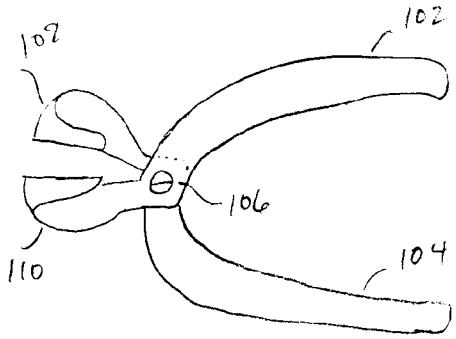
FIG. 5A shows a side view of one embodiment of a tool having a curved blade which both cuts the excess tie wrap and leaves the trimmed end with a rounded edge.
Figure 3:
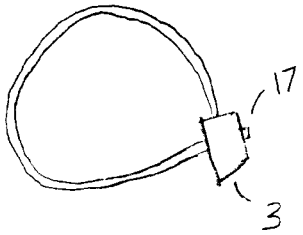
FIG. 3 shows a locked tie wrap that has been trimmed with cutters flush to the tie head.
Figure 4:
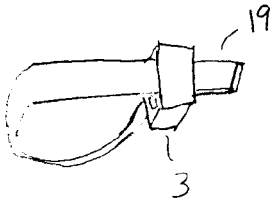
FIG. 4 shows a locked tie wrap that has been trimmed with cutters away from the tie head.
Figure 5B:
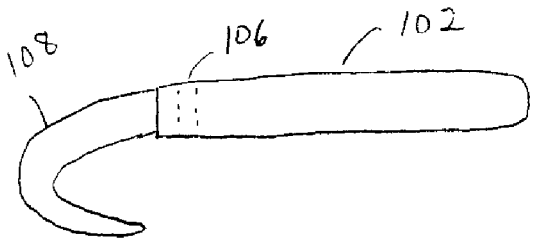
FIG. 5B shows a top view of the tool shown in FIG. 5A.

FIG. 5A shows a side view of one embodiment of a tool having a curved blade which both cuts the excess tie wrap and leaves the trimmed end with a rounded edge. The tool of FIG. 5A is a simple modification of a standard pair of cutters except the blades are curved. Two handles 102 and 104 pivot around a screw or bolt 106 that keeps the two handles together. Curved blades 108 and 110 are attached to each handle, and when the handles 102 and 104 are squeezed together, the curved blades 108 and 110 are forced together. In one embodiment, curved blade 110 is a cutting base that is not sharp, but provides a support against which the cutting blade 108 can apply pressure when the handles 102 and 104 are squeezed. FIG. 5B shows a top view of the tool shown in FIG. 5A.

In one embodiment, the blades are shaped to produce a "parabolic" cut. The parabolic cut need not conform to a particular mathematical formula, but reflects an overall shape. For purposes of this document, the terms "parabolic", "parabolically-shaped", "parabolically-curved", etc. may be used to refer to curves that are not entirely parabolic. Such curves may have a parabolic center with sides that extend away from the center in a linear fashion, such as in FIG. 8.

Figure 6:
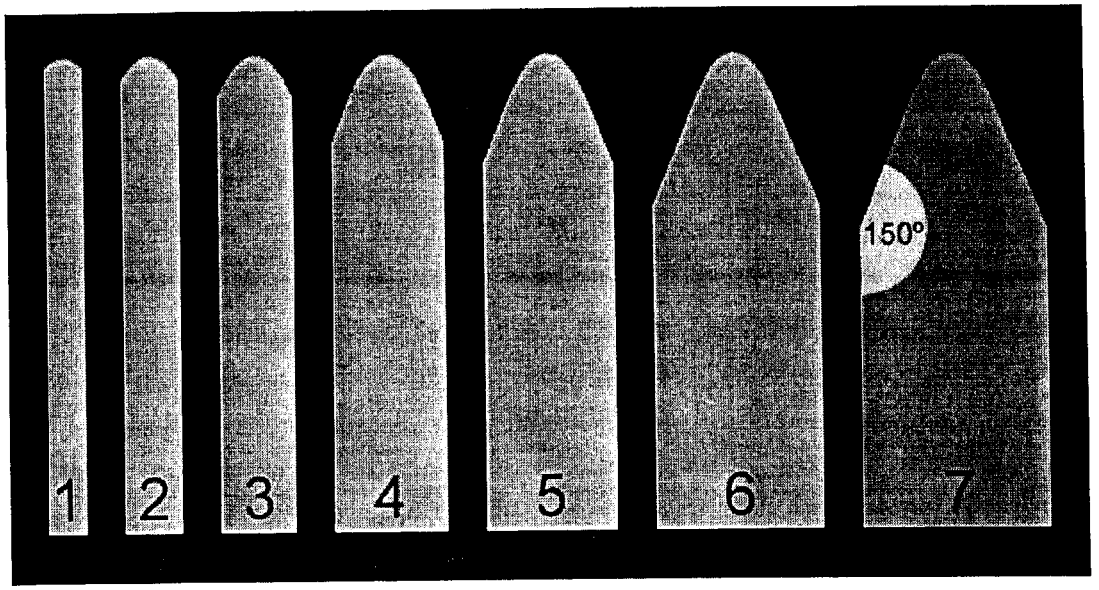
FIG. 6 shows that various widths of tie wrap can be accommodated by a single size blade.

As shown in FIG. 6, various widths of tie wrap can be accommodated by a single size blade. Different sized blades can be used for different ranges of tie wrap widths. As shown in FIG. 6, pieces #4–7 have approximately the same angle (150 degrees) at the edge of the tie wrap. Pieces #1–3 have a narrower edge angle than pieces #4–7. A smaller parabolic blade may be more effective with the tie wraps of smaller widths.

Figure 7:
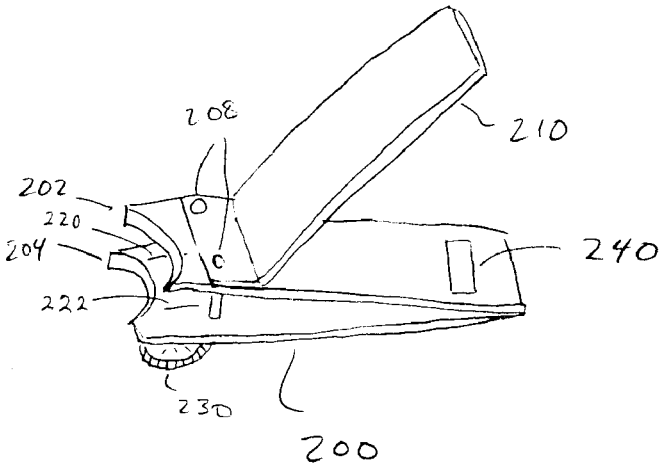
FIG. 7 shows another embodiment of a cutting tool with curved blades.

FIG. 7 shows another embodiment of a cutting tool with curved blades. It has a main body 200 comprising two curved blades 202 and 204, two pins 208 that couple the top of the main body to the bottom of the main body, and a handle 210 that serves as a lever for compressing the top of the main body to the bottom of the main body such that the blades 202 and 204 are forced together. Note that blades 202 and 204 may also alternatively be replaced by one blade and one cutting base, as previously described with respect to FIG. 5A.

In one embodiment, a guide is employed to maintain the proper alignment between the tie wrap and the cutter. This allows for a symmetric cut of the tie wrap that reduces sharp edges on both sides of the trimmed tie wrap.

Figure 8:
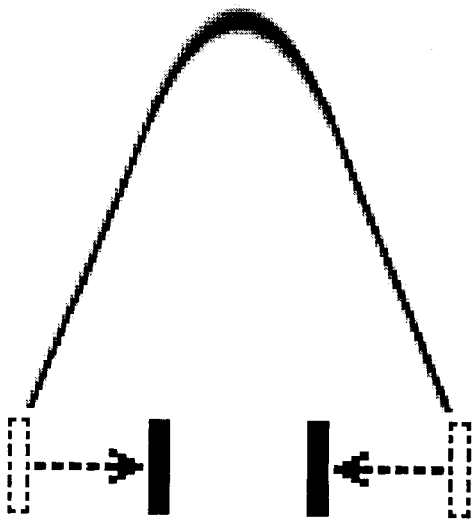
FIG. 8 shows a diagram of how a guide can help align a tie wrap with the cutting blade.

FIG. 8 shows a diagram of how a guide can help align a tie wrap with the cutting blade. In one embodiment a spin dial similar to that found on a crescent wrench is used to symmetrically adjust the position of guide walls 150 relative to a centerline 160 of the guide, which corresponds to the center of the cutting blade. The guide can be implemented either in front of or behind the blade. It may be implemented on both sides of the blade to provide better support.

Referring back to FIG. 7, a guide having guide walls 220 and 222 and an adjustment knob 230 is attached to the main body 200. A hole 240 allows long ends of tie wraps to extend out of the tool. In one embodiment, the adjustment knob 230 has an adjustment locking mechanism for fixing the guide walls to a specific width. This is useful when cutting multiple tie wraps of the same width.

Figure 9A:
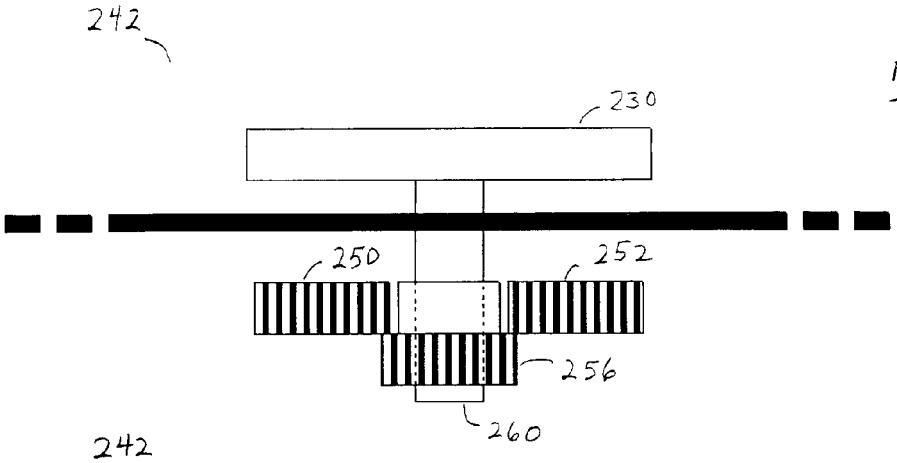
FIGS. 9A and 9B show one example of an adjustment locking mechanism.
Figure 9B:
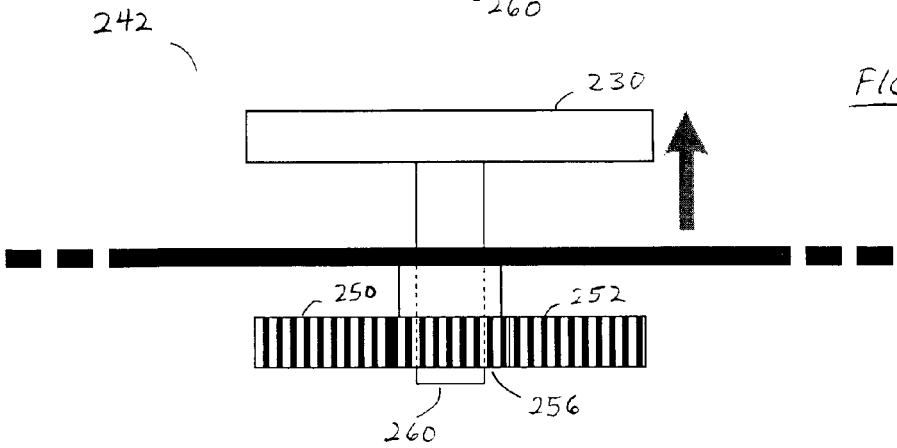

FIGS. 9A and 9B show one example of an adjustment locking mechanism 242. FIG. 9A shows a side view of adjustment knob 230 and interior gears 250 and 252 which are connected to move the two guide walls 220 and 222 (shown in FIG. 7). A gear 256 is attached at the end of an adjustment knob shank 260. When the adjustment knob 230 is pushed in as shown in FIG. 9A, the gear 256 is not engaged with gears 250 and 252, and the guide walls 220 and 222 are locked from further adjustment. FIG. 9B shows a side view of the adjustment knob 230 pulled out. Gear 256 is engaged with gears 250 and 252 to allow adjustment of the guide walls 220 and 222. The adjustment locking mechanism 242, of course, may be implemented in numerous other ways such as pulling the adjustment knob 230 out to lock, or using a pin or lever to prevent the adjustment knob from rotating.

Figure 5C:
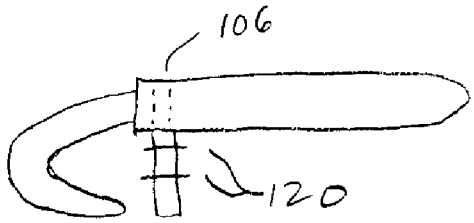
FIG. 5C shows a top view of one embodiment of a tool having a guide to align a tie wrap.
Figure 5D:
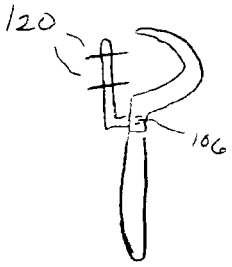
FIG. 5D shows a top view of another embodiment of a tool having a guide to align a tie wrap.

FIGS. 5C and 5D show top views of other embodiments of a guide extending from the screw 106 and having adjustable walls 120. FIG. 5C adds the guide to the embodiment of FIG. 5B. FIG. 5D shows an embodiment in which the handles are at a right angle to the tie wrap insertion orientation.

A clearance path behind the curved blade allows the tie wrap that is to be cut to extend past the curved blade. In the embodiment of FIG. 7, the hole 240 allows for the clearance path. In the embodiments of FIGS. 5A–5D, the clearance path is the free space behind the curved blade. Tie wraps vary in length, and the amount of clearance space needed varies by the length of the tie wrap and the girth of the materials to be bundled by the tie wrap. The clearance path should extend at least an inch and up to at least several inches. If the clearance path is not long enough, multiple cuts may have to be performed.

Figure 10:
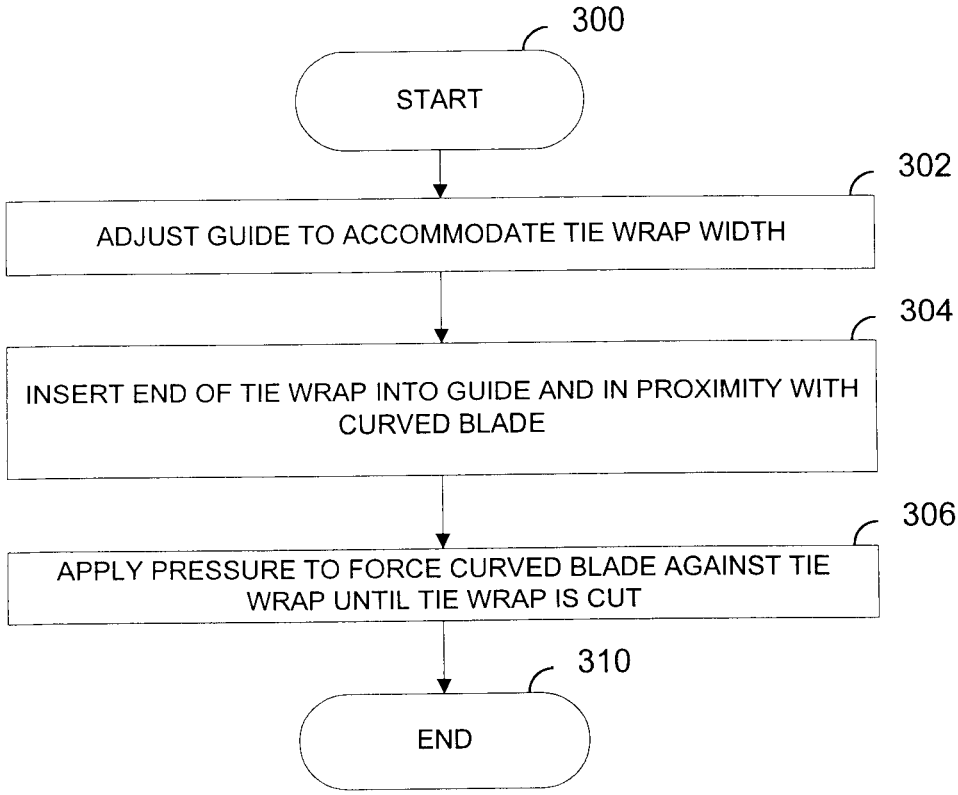
FIG. 10 is a flowchart showing a process of cutting a tie wrap.

FIG. 10 is a flowchart showing a process of cutting a tie wrap. The flowchart starts at block 300, and continues at block 302, at which a guide on the tool is adjusted for the width of the tie wrap to be cut. The guide can then be locked from further adjustment (until the guide is unlocked). At block 304, the end of a locked tie wrap is inserted into the guide in proximity of the curved blade. In one embodiment, a single curved blade is forced against a cutting surface. In another embodiment, two curved blades are forced together. At block 306, pressure is applied to force the curved blade to press against the tie wrap until the tie wrap is cut.

Thus, an apparatus and method of cutting an end of a tie wrap is described. However, the specific embodiments and methods described herein are merely illustrative. Numerous modifications in form and detail may be made without departing from the scope of the invention as claimed below. Rather, the invention is limited only by the scope of the appended claims.

What is claimed is:

1. A method of cutting an end of a tie wrap after a locking mechanism of the tie wrap has been engaged comprising:

inserting the tie wrap in proximity of a curved blade located at one end of a cutting tool;

inserting the end of the tie wrap through a hole spaced from the curved blade at an opposing end provided in the cutting tool to provide a clearance path in a free space behind the curved blade; and applying pressure to the cutting tool to force the curved blade against the tie wrap until the end of the tie wrap is cut through.

2. The method of claim 1, wherein the curved blade is parabolically-shaped.

3. The method of claim 2 further comprising:

inserting the end of the tie wrap into a guide of the cutting tool prior to applying pressure to the cutting tool, the guide of the cutting tool holding the tie wrap in a restricted orientation with respect to the curved blade.

4. The method of claim 3 further comprising:

adjusting the guide to accommodate a width of the tie wrap.

5. The method of claim 4, wherein the applying pressure to the cutting tool is done through a handle of the cuffing tool.

6. The method of claim 5 further comprising:

locking the guide from further adjustment.

7. The method of claim 1 further comprising:

leaving an amount of free tie wrap extending from a tie head to allow easy tightening of the tie wrap by pulling on the amount of free tie wrap extending from the tie head.

8. A method of trimming a tie wrap comprising:

inserting a free end of the tie wrap through a tie head;

inserting a free end of the tie wrap through a hole located at one end of provided in a cutting tool to provide a clearance path in a space behind a curved blade spaced from the hole at an opposing end; and cutting the free end of the tie wrap with the cutting tool having the curved blade.

9. The method of claim 8 further comprising:

using a guide to align the tie wrap with the curved blade.

10. The method of claim 9 further comprising:

adjusting the guide to accommodate a width of the tie wrap.

11. The method of claim 8, wherein the curved blade is parabolically-shaped.

12. The method of claim 8, wherein the tool is a handheld tool.

13. A method of cutting a locked tie wrap comprising:

positioning an end of the locked tie wrap in proximity with a blade having a curved cutting surface located at one end of a cutting tool;

inserting the end of the locked tie wrap through a hole spaced from the curved cutting blade at an opposing end provided in the cutting tool to provide a clearance path in a free space behind the curved blade;

applying pressure to the end of the locked tie wrap to make a curved cut in the end of the locked tie wrap.

14. The method of claim 13, wherein the curved cut made in the end of the locked tie wrap is substantially parabolic.

15. The method of claim 13 further comprising:

using a guide to align the locked tie wrap with the blade.

16. The method of claim 15 further comprising:

adjusting the guide to accommodate a width of the end of the locked tie wrap.

* * * * *